US008894139B1

(12) United States Patent
Coffey

(10) Patent No.: US 8,894,139 B1
(45) Date of Patent: Nov. 25, 2014

(54) COLLAPSIBLE LIGHTWEIGHT HAMMOCK CHAIR

(71) Applicant: Matthew Kevin Coffey, Woodland, WA (US)

(72) Inventor: Matthew Kevin Coffey, Woodland, WA (US)

(73) Assignee: Rambling Raven Designs, Ltd, Woodland, WA (US)

( * ) Notice: Subject to any disclaimer, the term of this patent is extended or adjusted under 35 U.S.C. 154(b) by 11 days.

(21) Appl. No.: 13/924,536

(22) Filed: Jun. 22, 2013

(51) Int. Cl.
*A47C 4/28* (2006.01)

(52) U.S. Cl.
CPC ..... *A47C 4/28* (2013.01)
USPC ..... 297/45

(58) Field of Classification Search
USPC ..... 297/45
See application file for complete search history.

(56) References Cited

U.S. PATENT DOCUMENTS

| | | | | | |
|---|---|---|---|---|---|
| 244,216 | A * | 7/1881 | Fenby | 297/45 X |
| 1,027,692 | A * | 5/1912 | Cole | 297/45 X |
| 2,689,602 | A * | 9/1954 | Morgan | 297/45 |
| 2,691,410 | A * | 10/1954 | Boucher | 297/45 |
| 3,124,387 | A * | 3/1964 | McClaren | 297/45 X |
| 4,124,188 | A * | 11/1978 | Machen | 297/45 X |
| 4,836,601 | A * | 6/1989 | Cone | 297/45 X |
| 5,054,849 | A * | 10/1991 | Hoff | 297/45 |
| 5,499,857 | A * | 3/1996 | Lynch, Jr. | 297/45 X |
| 5,718,473 | A * | 2/1998 | Lynch, Jr. | 297/45 X |
| 6,264,271 | B1 * | 7/2001 | Munn et al. | 297/45 |
| 6,447,057 | B1 * | 9/2002 | Chen | 297/45 X |
| 6,698,827 | B2 * | 3/2004 | Le Gette et al. | 297/45 X |
| 6,817,671 | B1 * | 11/2004 | Zheng | 297/45 X |
| 6,820,927 | B2 * | 11/2004 | Isom et al. | 297/45 X |
| 6,926,355 | B2 * | 8/2005 | Le Gette et al. | 297/45 X |
| 7,198,324 | B2 * | 4/2007 | Le Gette et al. | 297/45 X |
| 7,240,961 | B2 * | 7/2007 | Grace | 297/45 |
| 8,205,934 | B2 * | 6/2012 | Homans | 297/45 X |
| RE43,847 | E * | 12/2012 | Le Gette et al. | 297/45 X |
| 8,414,072 | B2 | 4/2013 | Phillips | |
| 8,646,835 | B2 * | 2/2014 | Homans et al. | 297/45 X |
| 2003/0006632 | A1 * | 1/2003 | Ku | 297/45 |
| 2003/0011217 | A1 * | 1/2003 | Le Gette et al. | 297/45 X |
| 2003/0080592 | A1 * | 5/2003 | Isom et al. | 297/45 X |
| 2007/0187998 | A1 * | 8/2007 | Chen | 297/45 |
| 2007/0200395 | A1 * | 8/2007 | Zheng | 297/45 |
| 2007/0267901 | A1 * | 11/2007 | Zheng | 297/45 |
| 2011/0169305 | A1 | 7/2011 | Ayre et al. | |
| 2012/0175917 | A1 | 7/2012 | Chen | |
| 2013/0069397 | A1 | 3/2013 | Homans et al. | |

* cited by examiner

*Primary Examiner* — Rodney B White
(74) *Attorney, Agent, or Firm* — Bruce E Harang

(57) ABSTRACT

Collapsible lightweight chairs having a pack weight of twenty ounces or less, and having enhanced side to side and front to back chair frame stability, and having a detachable back such that a variety of chair back supports may be utilized.

2 Claims, 10 Drawing Sheets

COLLAPSIBLE LIGHTWEIGHT HAMMOCK CHAIR

RELATED U.S. APPLICATION DATA

Provisional application No. 61/665,254, filed on Jun. 27, 2012.

FIELD OF THE INVENTION

The present invention relates to collapsible lightweight chairs. More particularly the present invention relates to collapsible chairs weighing twenty ounces or less, and having enhanced side to side and front to back stability. Additionally, the present invention relates to collapsible lightweight chairs which have a detachable back such that a variety of chair back supports may be utilized.

BACKGROUND

Lightweight, portable, collapsible, comfortable seating for backpackers and travelers has long been sought, but never yet achieved. Generally, backpackers who by definition are carrying all their equipment supported on their bodies such that every pound counts—will not take along a chair which weighs more than approximately two pounds, and preferably one pound or less. Existing solutions which can meet the two pounds-or-less requirement do not provide adequate functionality, while existing solutions which provide adequate functionality exceed the two pound target.

Backpackers, campers, beach-goers, and attendees at outdoor open-seating events use a variety of portable seating apparatus, but none provides sufficient functionality with sufficiently light weight and compact volume to be truly suitable for the purpose. Folding lawn chairs in various sizes are ubiquitous, but they include large rigid frame structures which, though collapsible to create a narrower profile, are relatively bulky and not suitable to pack in or suspend on a backpack for long trail hikes. The large frames also tend to create a minimum weight, below which they cannot be reduced and still support a reasonable weight. "Camp chairs" generally include bi-folded cushions or airbags, with a gusset strap to hold the cushions at a roughly right-angle orientation. Camp chairs provide very little support for the tired hiker's back and bottom, and must rest on the ground—which is uncomfortable if the ground has rocks or roots, or is wet and muddy. Thus, typical "camp chairs" are lightweight, but not functional. Other versions of "camp chairs" utilize lightweight telescoping or socketed pole frames and lightweight fabric sheets, but the telescoping/socketed vertical support members do not provide enough strength to safely and comfortably support an average-size person—i.e. greater than approximately 150 pounds. Additionally, the frame weight is all dead weight while hiking—even though collapsible—so the overall equipment weight carried by the backpacker is still greater than desired.

Thus, there is a need for a portable, collapsible chair for backpackers that can comfortably support people within a reasonable weight range—up to approximately 250-300 pounds, and has a packed weight that is twenty ounces, and preferably approximately sixteen ounces or less.

SUMMARY OF THE INVENTION

The present invention is directed to collapsible chairs weighing two pounds or less, and having enhanced side to side and front to back stability.

One object of the present invention is directed to collapsible lightweight chairs which have a detachable back such that a variety of chair back supports may be utilized.

Another object of the present invention provides for a collapsible lightweight chair having, enhanced side to side and front to back chair frame stability, and a detachable seat back allowing for a variety of chair back supports being utilized, comprising in co-operative combination: a collapsible lightweight chair base frame comprising; first and second front members, a front foot member, opposed first and second side members, front seat edge member, and first and second cross members, all of said members being elongated rods having opposed first and second distal ends and further having a mating joint disposed at each of said members said opposed distal ends; a plurality of couplings suitable for joining said members together forming said collapsible lightweight chair base frame and further for joining and the rear support members to said chair base frame; a cross member joint being suitable for connecting and positioning said cross members; three cable stays all having opposing distal ends connecting said side members and said front members thereby enhancing side to side and front to back said chair base frame stability; a pair of rear support members, both said members being elongated rods having first and second distal ends, said first distal ends mounted to said lightweight chair frame and said second distal ends mounted to the rear edge of the hammock seat portion; and a hammock seat portion having a pair of opposing side edges, a front edge and a rear edge, said front edge mounted between said side members and said rear edge mounted on said rear support members second distal ends; thereby producing a collapsible lightweight chair having, enhanced side to side and front to back chair frame stability, and a detachable seat back allowing for a variety of chair back supports being utilized.

A further object of the present invention provides for a collapsible lightweight chair having, enhanced side to side and front to back chair frame stability, and a detachable seat back allowing for a variety of chair back supports being utilized, comprising in co-operative combination: a collapsible lightweight chair base frame comprising; first and second front members forming the front legs and front foot, opposed first and second side members providing the rear legs, rear leg connecting member, and front seat edge member, all of said members being elongated rods having opposed first and second distal ends and further having a mating joint disposed at each of said members said opposed distal ends; a plurality of couplings suitable for joining said members together forming said collapsible lightweight chair base frame and further for joining and the rear support members to said chair base frame; a pair of crossing cable stays both having opposing distal ends connecting said side members diagonally thereby enhancing side to side chair base frame stability: a pair of cable stays both having opposing distal ends connecting said side members and said front members thereby enhancing side to side and front to back said chair base frame stability; a pair of rear support members, both said members being elongated rods having first and second distal ends, said first distal ends mounted to said lightweight chair frame and said second distal ends, each having an end cap mounted thereon, mounted to the rear edge of the hammock seat portion; a cross member coupling; and a hammock seat portion having a pair of opposing side edges, a front edge and a rear edge, said front edge mounted between said side members and said rear edge mounted on said rear support members second distal ends; thereby producing a collapsible lightweight chair having, enhanced side to side and front to back chair frame stability, and a detachable seat back allowing for a variety of chair back supports being utilized Generally, backpackers carry trekking poles for support while walking. Trekking poles have a striking tip disposed at a first end—which often includes a metal covered striking tip to contact the ground—and a hand grip disposed at the second end—or top end—for comfort. Cross country skiers utilize ski poles with a similar design. Trekking poles and ski poles are generally made from aluminum or carbon fiber tubing to achieve high strength with minimum weight. Because the backpacker/skier is already carrying this equipment, the inventor achieved maximum weight savings by designing the chair to utilize these trekking poles or ski poles as support members. Using this method, the inventor has created a collapsible chair weighing under 20 ounces packed weight, but strong enough to support a user of up to 250 to 300 pounds.

BRIEF DESCRIPTION OF THE DRAWINGS

The accompanying drawings, which are incorporated into and constitute a part of this specification, illustrate one or more embodiments of the present invention and, together with the detailed description, serve to explain the principles and implementations of the invention.

DETAILED DESCRIPTION

Before beginning a detailed description of the subject invention, mention of the following is in order. When appropriate, like reference materials and characters are used to designate identical, corresponding, or similar components in differing figure drawings. The figure drawings associated with this disclosure typically are not drawn with dimensional accuracy to scale, i.e., such drawings have been drafted with a focus on clarity of viewing and understanding rather than dimensional accuracy, In the interest of clarity, not all of the routine features of the implementations described herein are shown and described. It will, of course, be appreciated that in the development of any such actual implementation, numerous implementation-specific decisions must be made in order to achieve the developer's specific goals, such as compliance with application- and business-related constraints, and that these specific goals will vary from one implementation to another and from one developer to another. Moreover, it will be appreciated that such a development effort might be complex and time-consuming, but would nevertheless be a routine undertaking of engineering for those of ordinary skill in the art having the benefit of this disclosure.

Referring to FIGS. 1-3, 7-14, and 16-17, an embodiment of a collapsible hammock chair 10 is shown, including a base frame 12, a hammock portion 14, and first and second rear support posts 16 and 18, respectively.

Figure 16:
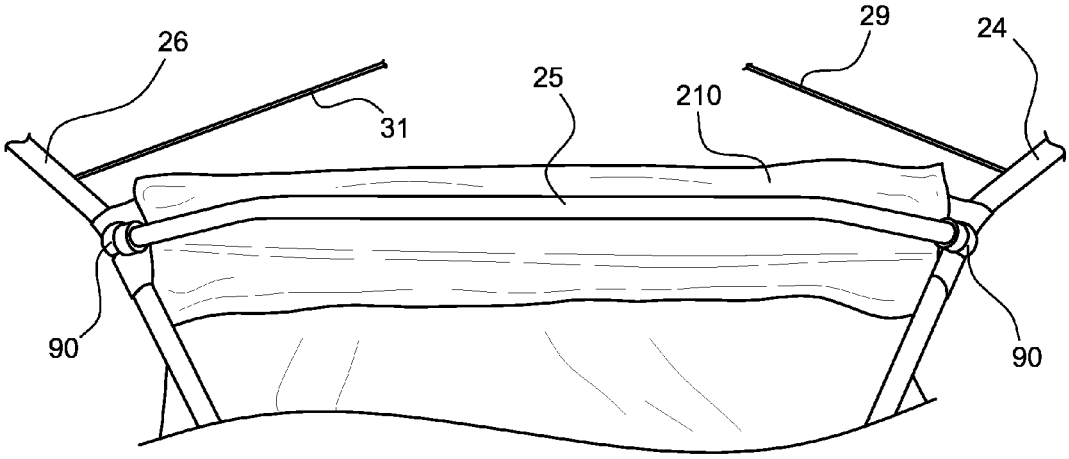
FIG. 16 shows a bottom perspective view of the chair front cross member of the preferred embodiments of the claimed invention.

Each frame 12 includes a plurality of tubular frame members, including first and second front members 20 and 22, opposed first and second side members 24 and 26, first and second cross members 28 and 30, and front seat edge cross member 25 (see FIG. 16).

Each said frame member 20, 22, 24, 26, 28, and 30 comprises an elongated rod having opposed first and second distal ends and a coupling disposed at each of their respective first and second distal ends. In this embodiment, the couplings comprise simple male/female mating ferrules, particularly spigot ferrules.

Each frame 12 includes a plurality of joints, 80, 82, 84, 86 and 88, removably coupling the base members. Front foot joint 80 removably engages the first 20 and second 22 front member first ends at their respective couplings. First top joint 82 removably engages the first front member second end and the first side member second end at their respective couplings. Second top joint 84 removably couples the second front member second end and the second side member second end at their respective couplings. First rear foot joint 86 removably couples the first side member first end and the first cross member first end at their respective couplings. Second rear foot joint 88 removably couples the second side member first end and the second cross member first end at their respective couplings.

Figure 17:
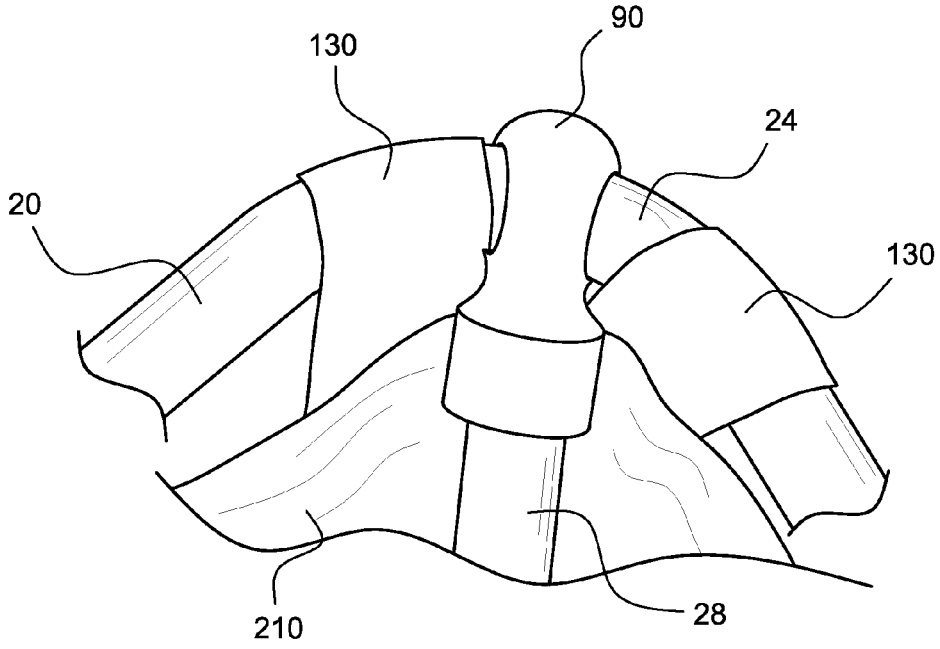
FIG. 17 shows a plan view of the front hammock connected to the chair side support member by means of the hammock front connection loops and the chair front cross member connected to the chair side support by means of chair support connector adapter of the preferred embodiments of the claimed invention.
Figure 18:
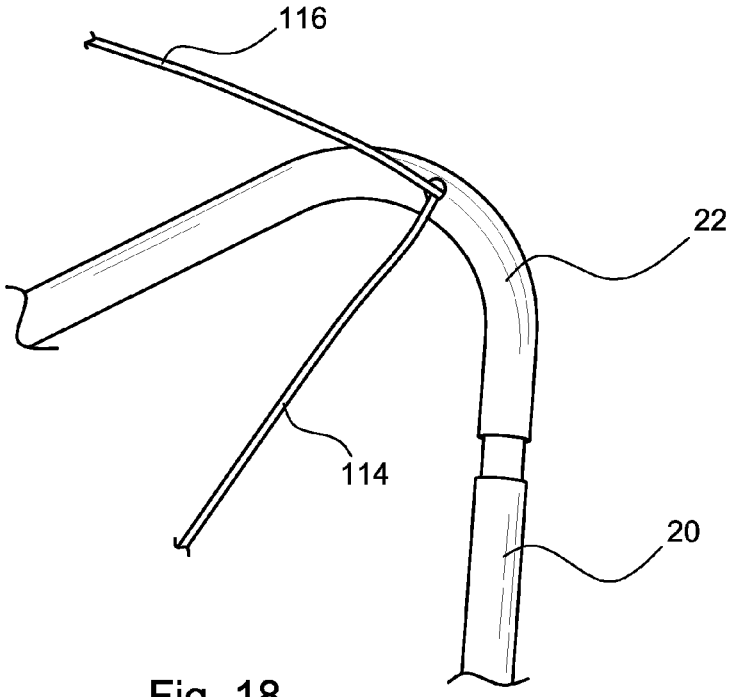
FIG. 18 shows a close-up plan view of the foot portion of the front chair legs with the chair support legs partially connected via a spigot ferrule connector as well as the cable support members of the preferred embodiments of the claimed invention.

Referring to FIG. 17, there is shown a first upper coupling joint 90 disposed proximate the first top joint removably engages the second cross member second end coupling 28 to the respective first front member 20 and first side member 24. Alternatively, the respective top joint and upper cross member joint could be formed as a unitary rigid component. Also shown is the hammock seat 14 connected by means of mounting loops 130.

Figure 7:
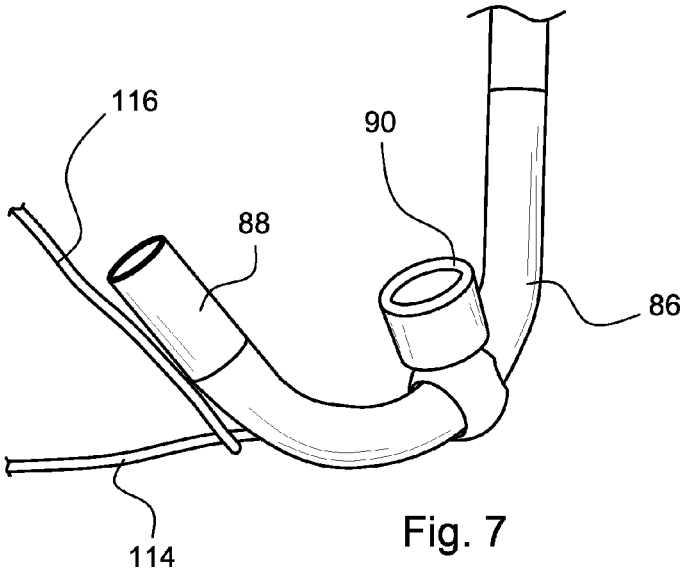
FIG. 7 shows a perspective close-up view of the rear leg foot section of one preferred embodiments of the claimed invention.

Referring now to FIG. 7 there is shown a rear foot joint 86, showing an unconnected male ferrule joint at a first distal end and at the second distal end a female ferrule joint mated to side member 24. Also shown is mounted joint coupling 90 as well as cables 114 and 116.

In this embodiment, each of the front foot joint 80 and first and second rear foot joints 86 and 88 form first, second and third ground contact portions, respectively, when the base member ends arc coupled to their respective joints, forming an approximate triangle, ensuring adequate stability in use.

In this embodiment, first, second and third cable stays 112, 114, and 116, respectively, having opposed first and second distal ends. First cable stay 112 is couplable at its first distal end to the front foot joint 80 and at its second distal end to the first rear foot joint 86. Second cable stay 114 is couplable at its first distal end to the front foot joint 80 and at its second distal end to the second rear foot joint 88. First and second cable stays 112 and 114 may be comprised of a single cable looped through a ferrule connected to front foot joint 80, in order to provide self-adjustment and avoid the need to precise matching of the lengths.

Third cable stay 116 is couplable at its first distal end to a first anchor set proximate said first-top joint 82, and at its second distal end to a second anchor proximate second top joint 84. In the embodiment, first and second anchors comprise rivets set into their respective top joints, in the front portion of the respective top joint (i.e. past the top of the arch portion of each top joint). Third cable stay 116 extends from a first anchor internally through first side member 24, and first rear foot joint 86, exiting first rear foot joint 80 through a first aperture to enter second rear foot joint 88 through a second aperture, extending internally through second rear foot joint 88, second side member 26 and second top joint 84 so the cable stay second distal end is coupled at a second anchor. Third cable stay 116 therefore performs a dual purpose, it ties the first and second rear foot joints together, and the members coupled to the foot joints, to prevent them from spreading too far apart and collapsing the chair. And, the third cable stay transfers this tension from the spreading force to compress first and second side members 24 and 26 into their respective joints and fittings, and through these joints and fittings into first and second cross members 28 and 30, so that they do not become disconnected when a user shifts their weight in the chair 10.

In this embodiment, cable stays 112, 114 and 116 are lightweight galvanized steel wire, but any material of suitable strength may be used, such as string, fishing line, nylon straps, picture hanging wire, or similar materials. Cable stays 112, 114 and 116 may be removably couplable, or may be permanently coupled.

Figure 8:
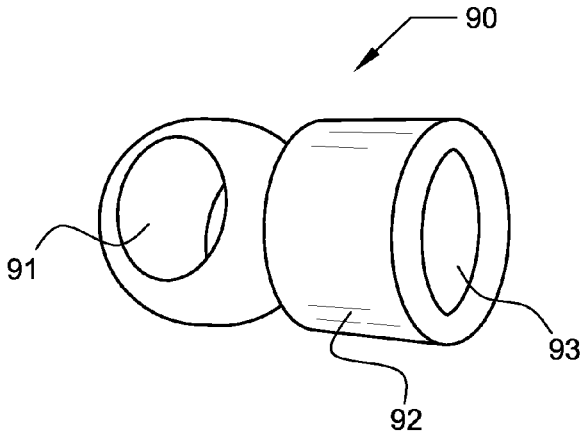
FIG. 8 shows a perspective view of a chair support connector of the preferred embodiments of the claimed invention.
Figure 9:
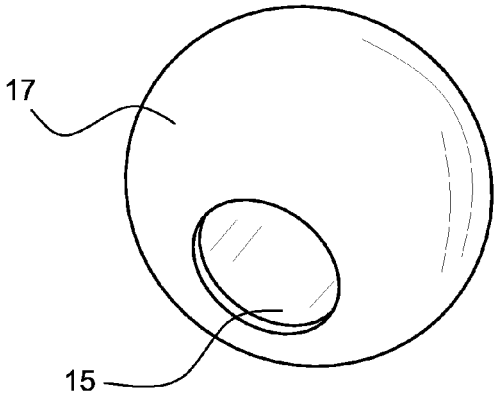
FIG. 9 shows a perspective view of a back support end cap of the preferred embodiments of the claimed invention.
Figure 11:
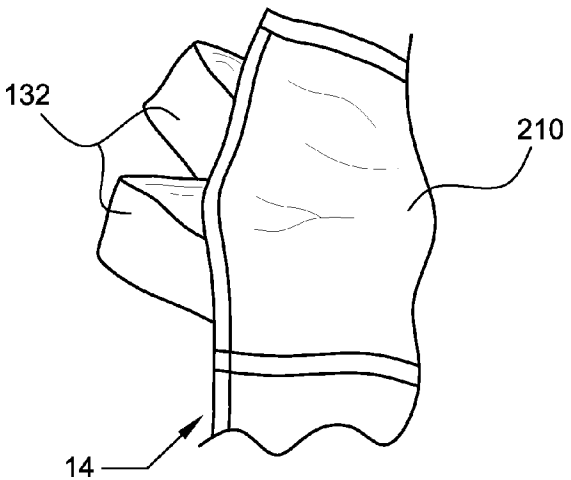
FIG. 11 shows a close-up plan view of the hammock front connection loops of the preferred embodiments of the claimed invention.
Figure 10:
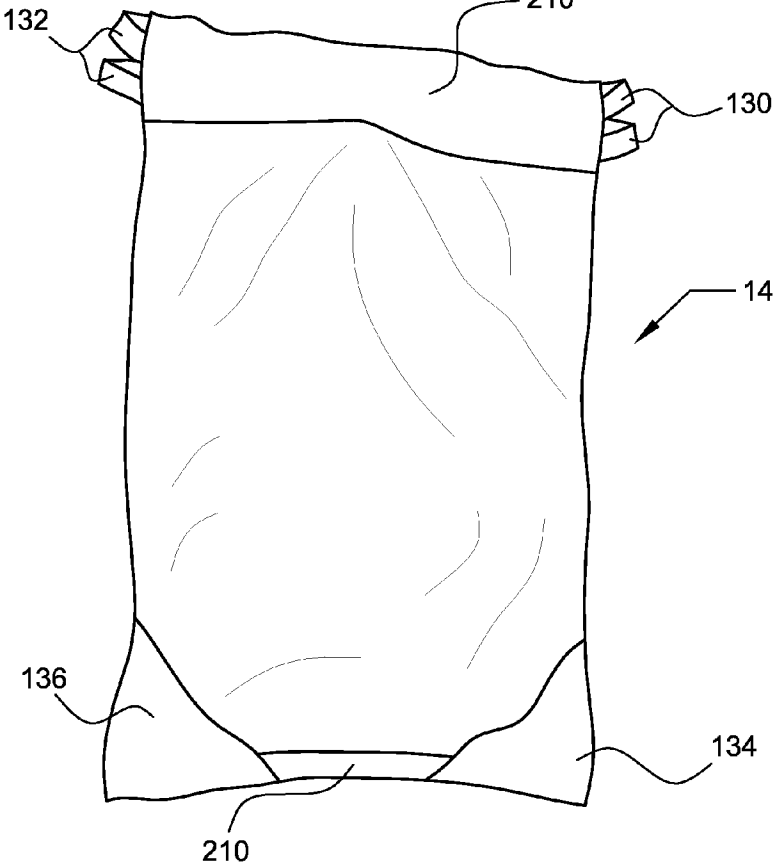
FIG. 10 shows a plan view of the hammock portion of the preferred embodiments of the claimed invention.
Figure 12:
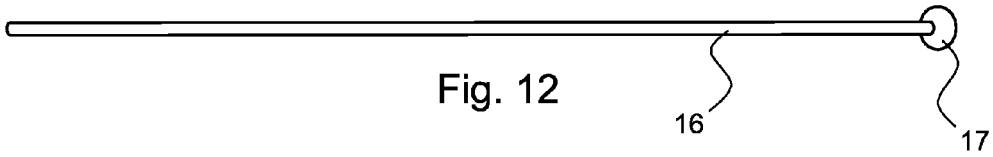
FIG. 12 shows a plan view of a back support with the back support end cap as shown in FIG. 9 mounted thereon of the preferred embodiments of the claimed invention.

A coupling adaptor 90 is disposed proximate the first rear foot joint 86 removably receives a first distal end of first rear support post 16 having opposed first and second distal ends. A second coupling adaptor 90 is disposed proximate the second rear foot joint 88 removably receives a first distal end of a second rear support post 18 having opposed first and second distal ends. Referring to FIG. 8, each coupling adapter 90 comprises a molded plastic piece having a body 91 with a mounting bore 91 and a coupling bore 93. Said coupling bore suitable for coupling back poles 17 to the chair frame. In the embodiment shown, dedicated poles are shown as substitutes for trekking poles.

Hammock portion 14 includes opposed first and second front connectors 130 and 132 to couple hammock portion 14 to the first and second top joints, 82 and 84, respectively, and first and second rear connectors 134 and 136 to removably couple hammock portion 14 to the second distal ends of the second and first rear support posts 16 and 18, respectively. In the embodiment, hammock portion first and second front connectors 130 and 132 are sewn as closed loops to receive first and second top joints 82 and 84. Alternatively, hammock first and second front connectors 130 and 132 can be removably couplable to the respective first and second top joints for easier stowage and replacement.

Figure 13:
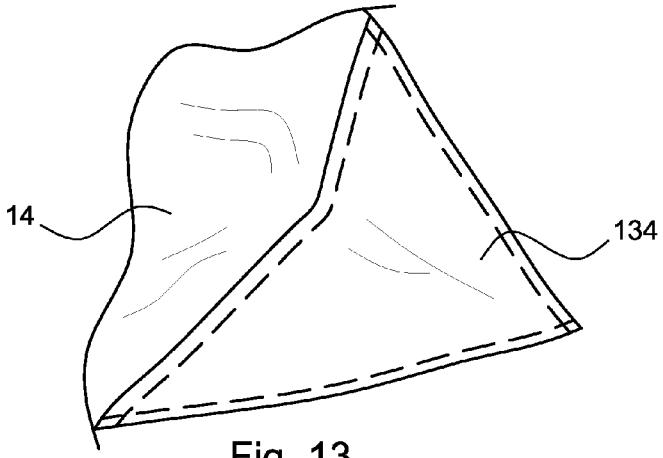
FIG. 13 shows a close-plan view of the hammock rear back support mounting pockets of the preferred embodiments of the claimed invention.
Figure 14:
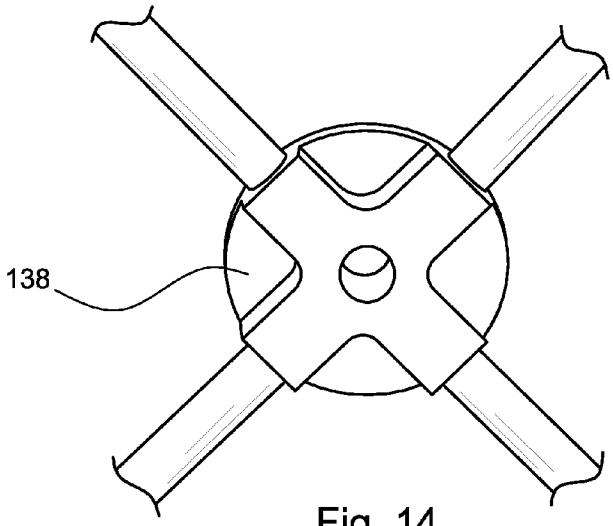
FIG. 14 shows a close-up view of the rear chair support connection cross member of a preferred embodiment as shown in FIG. 1 of the claimed invention.
Figure 15:
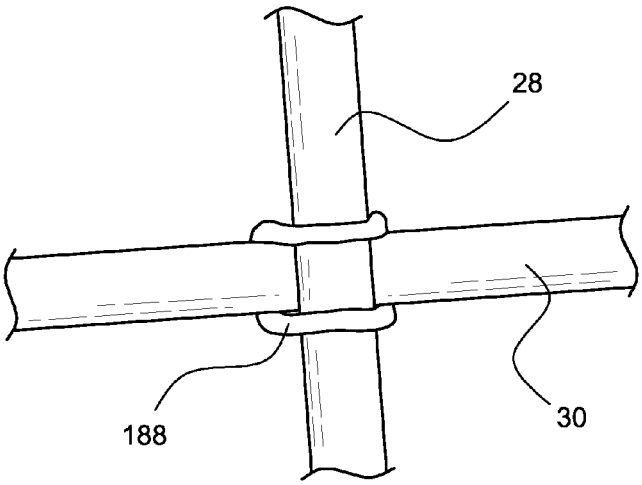
FIG. 15 shows a close-up plan view of the rear back support poles of the preferred embodiment as shown in FIG. 5 of the claimed invention.

In this embodiment, hammock first and second rear connectors 134 and 136 are pockets having an open seam to receive the respective rear support post second distal ends. In this way, they are able to receive larger diameter portions, such as a hand grip of a trekking pole or ski pole, for example. Alternatively, first and second hammock rear connectors 134 and 136 could be specifically adapted to couple to rear support post 16 and 18 which are specifically designed for the chair, in order to provide a more precise fit. Referring to FIG. 13, in this embodiment, hammock portion front edge 210 and rear edge 212 are folded and double-stitched for improved edge strength, and to reinforce connectors 130, 132, 134 and 136.

Configuring the first and the second foot adaptors 90, and the first and the second hammock rear pockets 134 and 136, to use trekking poles' or ski poles' maximum flexibility and minimum weight, because the backpacker or skier is already carrying these items, so the added weight of separate, dedicated support posts is avoided. Conversely, because the rear support posts 16 and 18 are the longest linear members in the support structure and subject to substantial bending and buckling forces, providing posts with adequate strength to safely support people up to 250-300 pounds would require significantly heavier tubing than used for the base members. Therefore, the collapsible hammock chair 10 is adapted to use trekking poles or ski poles, which are sturdy by design, and which the user is already carrying.

In this embodiment base tubular frame members each comprise a pair of segments, each segment including an opposed coupling, each frame member first segment removably engaged to its respective frame member second segment at their respective couplings, and each coupling further including an elastic keeper maintaining the respective frame member segment connected when the segments are disengaged at their respective segment couplings.

Referring to FIGS. 5, and 1-3 there is shown an embodiment; base frame 12 includes including a cross member joint 138 to couple the first and second cross members, 28 and 30, at their intersection located between their respective first and second ends, in order to provide greater mutual support. First and second cross members 28 and 30 each comprise first and second segments, with each said segment having opposed first and second segment distal ends. Cross member joint 138 comprises a unitary member having four couplings 90 disposed to removably couple cross member segment distal ends. In the embodiment, couplings are sockets having internal shoulders to receive the segment ends, with first and second intersecting channels extending between couplings.

Elastic keepers connecting the segments are routed through said intersecting channels, to allow them to disengage but remain connected for easy assembly and stowage. Alternatively, said couplings, and intersecting channels, may include open slots to removably receive the said elastic keepers into the respective channels, so that the cross member joint 138 may be completely removed for stowage or replaced, or to simplify manufacture. In this embodiment, cross members 28 and 30 are removably couplable to first and second rear coupling joints 90, without elastic keepers, to provide the most compact storage.

Inserts are provided internally to the tubular frame members to provide anchor points and guides for said elastic keepers, and for third cable stay 116. In the claimed embodiments, said inserts are made from metal, most preferably aluminum metal, but could be made from any suitable material and fixation method. in the embodiment, tubular frame members 20, 22, 24, 26 and cross member segments, comprise sub-segments which can be decoupled in order to reduce stowage lengths.

In this embodiment said elastic rear chair support keepers comprise separate lengths of elastic shock cord for each member. The elastic keeper is anchored to the distal inserts at opposing ends of the cord. Alternatively, the elastic keepers may comprise a single strand of elastic material extending through each of the members, segments, joints and couplings, with a first end anchored approximately within the first cross member second distal end and a second end anchored within said second cross member second distal end, in order to save weight and cost from inserts.

Referring now to FIGS. 4-6, 8-13, 15-18 there is shown the most preferred embodiment of the claimed invention of a collapsible hammock chair 10, including a base frame 12, a hammock portion 14, and first and second rear support posts 16 and 18, respectively.

Figure 1:
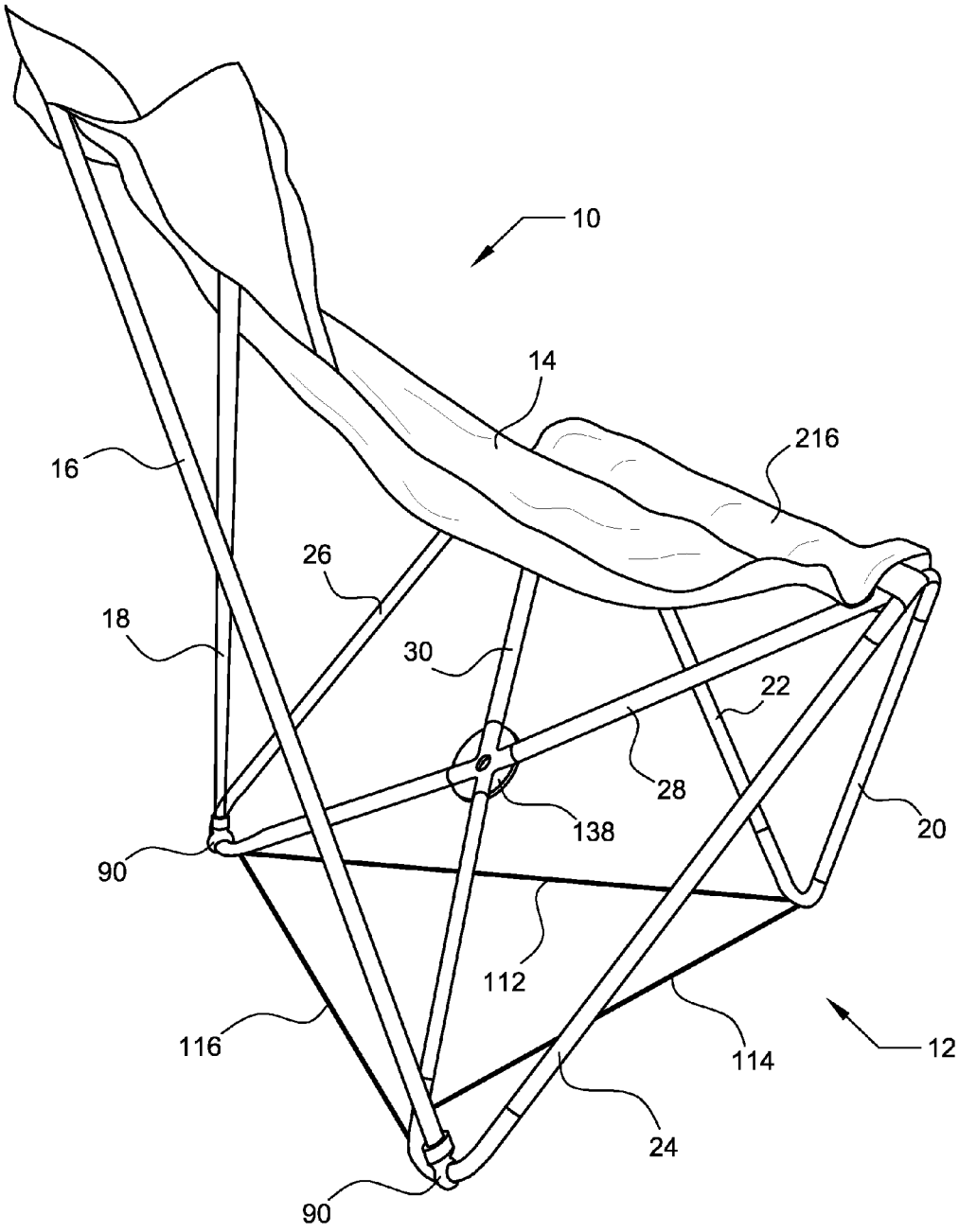
FIG. 1 shows a left rear perspective view of one preferred embodiment of the claimed invention.
Figure 2:
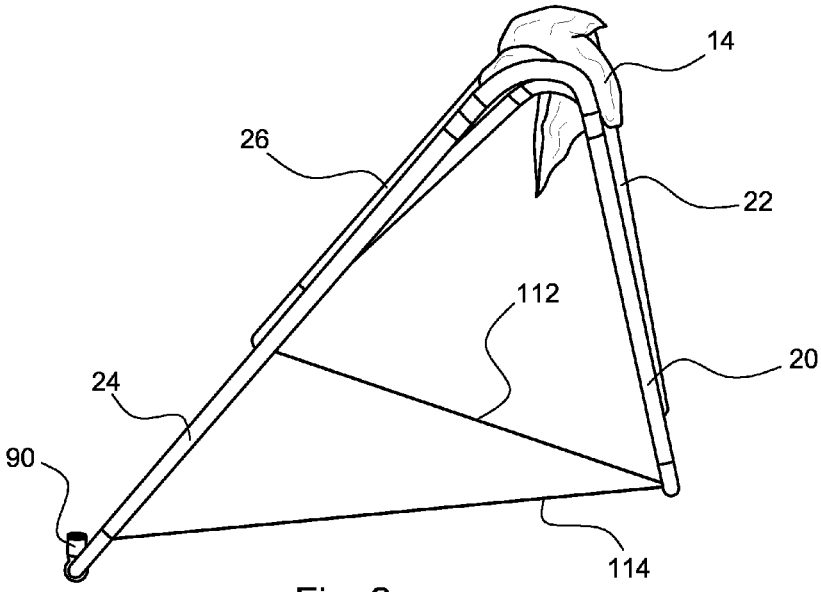
FIG. 2 shows a left side perspective view of the preferred embodiment of the claimed invention as shown in FIG. 1, with the chair back support posts removed and hammock portion folded on the chair front cross member.
Figure 3:
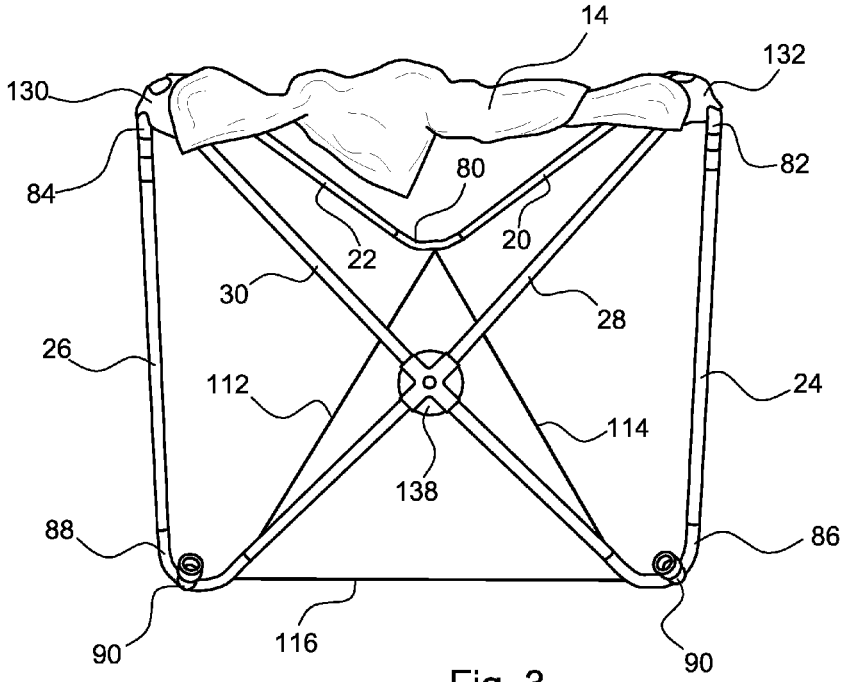
FIG. 3 shows a rear perspective view of the preferred embodiment of the claimed invention as shown in FIG. 1, with the chair back support posts removed and the hammock portion folded on the chair front cross member.
Figure 4:
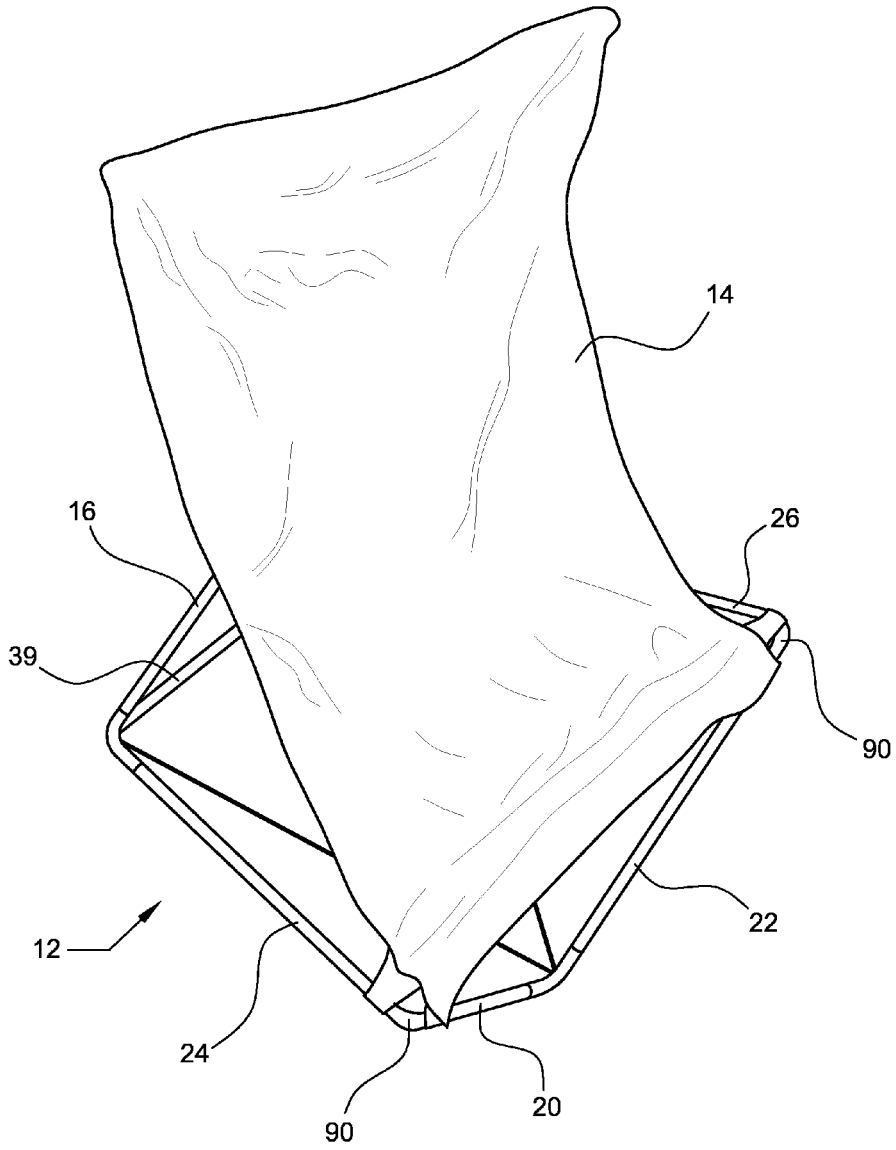
FIG. 4 shows a top right front perspective view of another preferred embodiment of the claimed invention.
Figure 5:
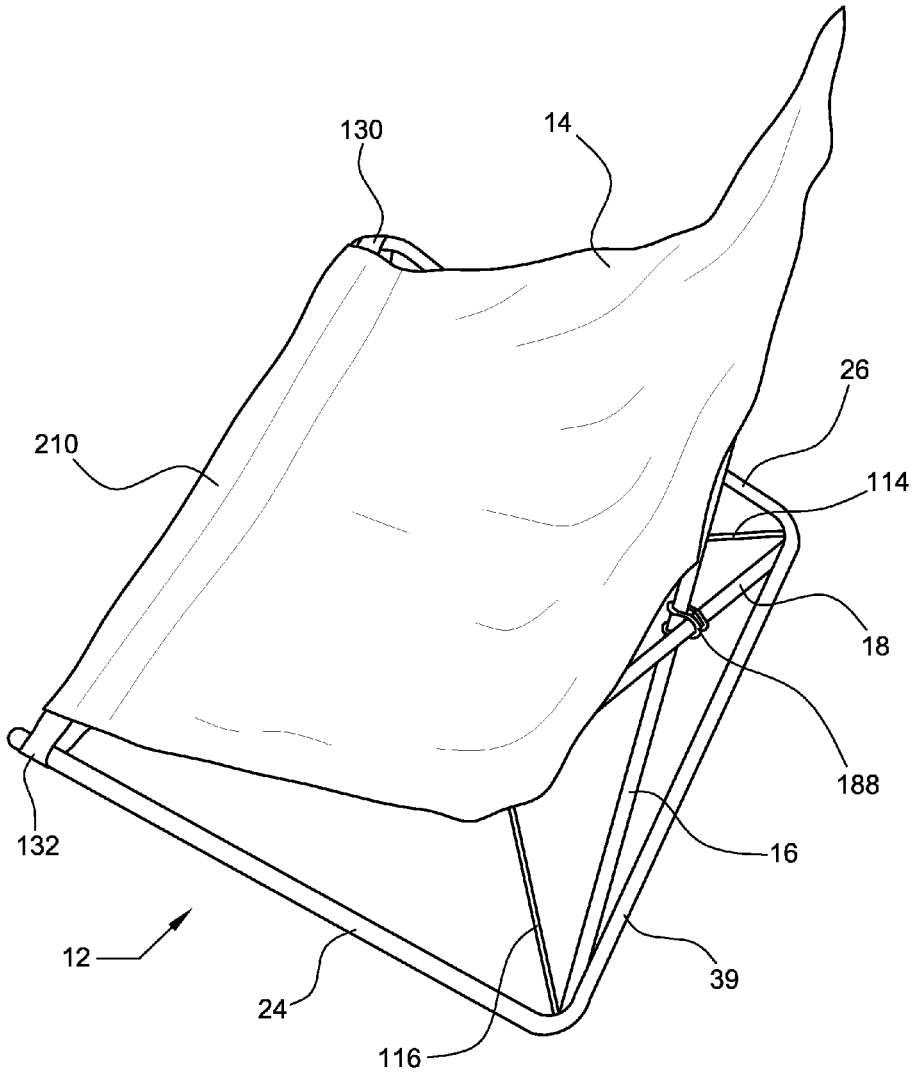
FIG. 5 shows a top left rear perspective view of the preferred embodiment of the claimed invention as shown in FIG. 4.
Figure 6:
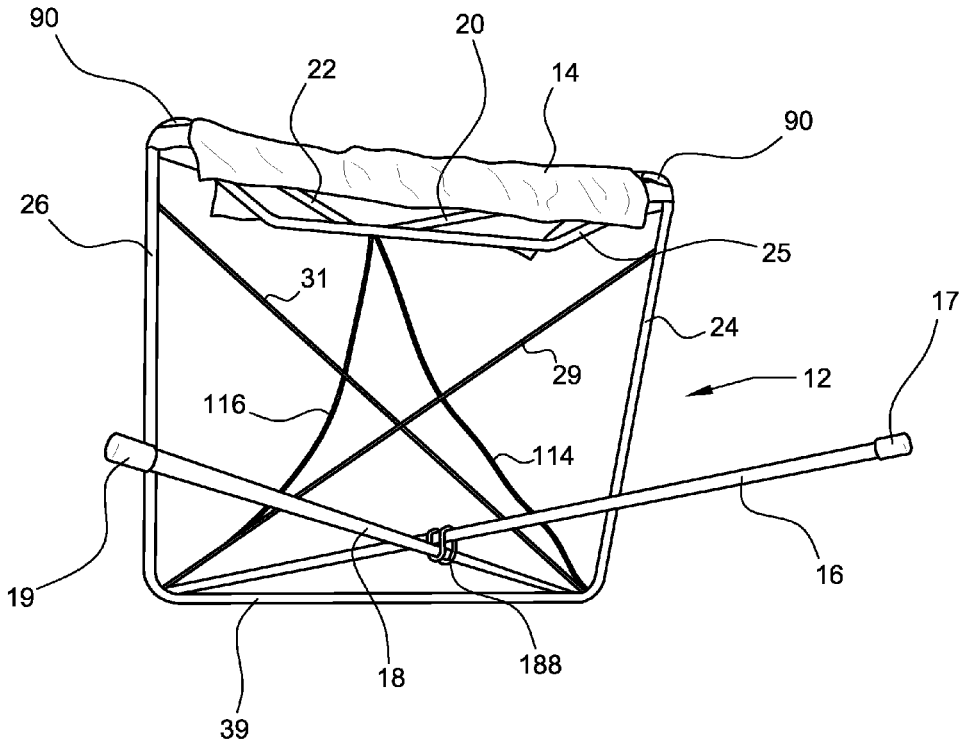
FIG. 6 shows a rear perspective view of the preferred embodiment of the claimed invention as shown in FIG. 4, with chair back support posts in place and the hammock portion folded on the chair front cross member.

Each base frame 12 includes a plurality of tubular frame members, including a first front member 20 and a second front member 22, opposed first and second side members 24 and 26 rear member 29, and front cross member 25 (see FIG. 6).

Tubular frame member 20 comprises a J-shaped member having opposing first and second distal ends. The short leg of the J (first distal end) connects to one distal end of tubular frame member 22 forming both the opposite front side tubular member and the front foot portion of the base frame 12. The long leg of the J (second distal end) connects, by means of a joint to tubular frame member 24.

Tubular frame member 22 comprises a straight member having opposing first and second distal ends and has a joint along its length, preferably substantially in the center of its longitudinal axis.

Similarly to tubular frame member 20, tubular frame members 24 and 26 each comprise a J-shaped member having opposing first and second distal ends. The short leg of the J (first distal end) of each connects by means of a joint to said second distal end of tubular members 20 and 22. The long leg of the J (second distal end) of each tubular member 24 and 26 connects by means of a joint to one of two opposing distal ends of tubular frame member 39.

Tubular frame rear leg connecting member 39 comprises a U-shaped member having a pair of opposing short leg portions at substantially right angles to the main center body portion of said tubular frame rear leg connecting member 39. Further tubular frame rear leg connecting member 39 has a bore located near each distal end compatible to accept one distal end of rear support posts 16 and 18 respectively.

Cable stays 29, 31, 114 and 116 each comprise a length of flexible cable each having first and second opposing distal ends. The first distal end of cable stays 31 and 114 are fixedly attached near the first distal end of tubular frame rear leg connecting member 39 and first distal end of cable stays 29 and 116 are fixedly attached near the second distal end of tubular frame rear leg connecting member 39. The second distal end of cable stays 29 and 31 are fixedly attached near the short leg of the J of each of tubular frame member 24 and 26. Likewise, the second distal end of each of cable stays 114 and 116 are fixedly attached to said short leg of the J (first distal end) of tubular frame member 20 forming the front foot portion of the base frame 12.

Tubular frame member 25 having opposing first and second distal ends is mounted to frame members 20 and 22 by means of a couplings 90, one such coupling being removably mounted by a first coupling bore 93 on first distal end 92 and each said coupling 90 being fixedly mounted by means of bore 91 to side members 22 and 24 respectively.

Back support posts 16 and 18 both comprise multi jointed hollow tubular rods each having opposing first distal and second distal ends. The first distal end of each of said back support posts 16 and 18 mount to said chair frame 12 by means of said bores located near each distal end compatible to accept one distal end of rear support posts 16 and 18 respectively. The second distal end of each of said back support posts 16 and 18, each having an end cap 17 mounted thereon, removably mounted to said hammock 14 by means of hammock rear connector pockets 134 and 136 respectively. Preferably, said back support posts 16 and 18 are connected together at substantially their longitudinal axis center points by a back support post cross member coupling 188.

Hammock 14 is mounted to said chair frame 13 in the same manner as disclosed hereinabove for the first described embodiment of the claimed invention.

Preferably said joints are spigot ferrules well known in the art and requiring no further comment herein.

The embodiments shown are sized to provide a hammock chair for sitting, but the size may be extended to provide a lightweight hammock, as well. Those skilled in the art will recognize that numerous modifications and changes may be made to the preferred embodiment without departing from the scope of the claimed invention. It will, of course, be understood that modifications of the invention, in its various aspects, will be apparent to those skilled in the art, some being apparent only after study, others being matters of routine mechanical, chemical and electronic design. No single feature, function, or property of the preferred embodiment is essential. Other embodiments are possible, their specific designs depending upon the particular application. As such, the scope of the invention should not be limited by the particular embodiments herein described but should be defined only by the appended claims and equivalents thereof.

What is claimed is:

1. A collapsible lightweight chair having, enhanced side to side and front to back chair frame stability, and a detachable seat back allowing for a variety of chair back supports being utilized, comprising in co-operative combination:

a) a collapsible lightweight chair base frame comprising; first and second front members, a front foot member, opposed first and second side members, front seat edge member, and first and second cross members, all of said members being elongated rods having opposed first and second distal ends and further said front members, said front foot member, and said opposed side members having a mating joint disposed at each of said opposed distal ends, said mating joints thereby providing removable connection among said members;

b) a plurality of coupling adapters suitable for removably joining said front seat edge member and one distal end of each of said first and second cross members to said chair base frame;

c) a rear chair support member joint being suitable for connecting and positioning said cross members;

d) three cable stays all having opposing distal ends connecting said side members and said front members, thereby enhancing side to side and front to back chair base frame stability;

e) a pair of rear support members, both said rear support members being elongated rods having first and second distal ends, said first distal ends mounted in a said coupling to said lightweight chair frame and said second distal ends for being mounted in a hammock rear connector to a rear edge of a hammock seat portion; and f) a hammock seat portion having a pair of opposing side edges, a front edge and a rear edge, said front edge mounted between said side members and said rear edge mounted on said second distal ends of said rear support members;

thereby producing a collapsible lightweight chair having, enhanced side to side and front to back chair flame stability, and a detachable seat back allowing for a variety of chair back supports being utilized.

2. A collapsible lightweight chair having, enhanced side to side and front to back chair frame stability, and a detachable seat back allowing for a variety of chair back supports being utilized, comprising in co-operative combination:

a) a collapsible lightweight chair base frame comprising; first and second front members forming the front legs and front foot, opposed first and second side members providing the rear legs, rear leg connecting member, and front seat edge member, all of said members being elongated rods having opposed first and second distal ends and further said front members, said opposed side members and said rear leg connecting member all having a mating joint disposed at each of said opposed distal ends, thereby providing removable connection among said members;

b) a plurality of coupling adapters suitable for joining said front seat edge member to said collapsible lightweight chair base frame;

c) a pair of crossing cable stays both having opposing distal ends connecting said side members diagonally, thereby enhancing side to side chair base frame stability;

d) a pair of cable stays both having opposing distal ends connecting said side members and said front members, thereby enhancing side to side and front to back chair base frame stability;

e) a pair of rear support members, both said rear support members being elongated rods having first and second distal ends, said first distal ends mounted in a said coupling adapter to said lightweight chair frame and said second distal ends, each having an end cap mounted thereon mounted in a hammock rear connector to a rear edge of a hammock seat portion;

f) a back support member coupling; and g) a hammock seat portion having a pair of opposing side edges, a front edge and a rear edge, said front edge mounted between said side members and said rear edge mounted on said second distal ends of said rear support members;

thereby producing a collapsible lightweight chair having, enhanced side to side and front to back chair frame stability, and a detachable seat back allowing for a variety of chair back supports being utilized.

* * * * *